US006428158B1

(12) United States Patent
Szlucha

(10) Patent No.: US 6,428,158 B1
(45) Date of Patent: Aug. 6, 2002

(54) LIQUID INK PRINTER HAVING A HEAT AND HOLD DRIER

(75) Inventor: Thomas F. Szlucha, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 08/964,991

(22) Filed: Nov. 5, 1997

(51) Int. Cl.[7] ..... B41J 2/01
(52) U.S. Cl. ..... 347/102
(58) Field of Search ..... 347/102

(56) References Cited

U.S. PATENT DOCUMENTS

| | | | | |
|---|---|---|---|---|
| 4,970,528 A | | 11/1990 | Beaufort et al. | |
| 5,005,025 A | | 4/1991 | Miyakawa et al. | |
| 5,214,442 A | | 5/1993 | Roller | |
| 5,274,400 A | | 12/1993 | Johnson et al. | |
| 5,287,123 A | | 2/1994 | Medin et al. | |
| 5,500,667 A | | 3/1996 | Schwiebert et al. | |
| 5,633,668 A | * | 5/1997 | Schwiebert et al. | 347/102 |
| 5,691,756 A | * | 11/1997 | Rise et al. | 347/102 |
| 5,754,208 A | * | 5/1998 | Szlucha | 347/102 |

FOREIGN PATENT DOCUMENTS

JP 7-304167 * 11/1995

* cited by examiner

*Primary Examiner*—John Barlow
*Assistant Examiner*—Michael Brooks
(74) *Attorney, Agent, or Firm*—Tallam I. Nguti

(57) ABSTRACT

A printing machine for printing an image including colorants, including a liquid carrier, on a recording medium moving along a path through a pre-print zone and a print zone including a heat and hold drier. The printing machine includes a printhead, disposed adjacent the print zone, to deposit the colorants, including the liquid carrier, on the recording medium during movement through the print zone, a pre-print zone drier, disposed adjacent the pre-print zone, to generate a heat energy, towards the recording medium, sufficiently elevated for retention in the recording medium during movement thereof through the print zone. The pre-print zone drier includes the function of heat and hold where the pre-heat drier heats the recording medium sufficiently such that the mass of the recording media holds or stores the heat energy during printing in the print zone such that a drier is either not necessary at the print zone or the a drier generating less heat energy than the pre-heat drier is used to maintain the level of stored heat energy.

5 Claims, 6 Drawing Sheets

LIQUID INK PRINTER HAVING A HEAT AND HOLD DRIER

FIELD OF THE INVENTION

This invention relates generally to a liquid ink printing machine and more particularly to a liquid ink printer having a heat and hold drier.

BACKGROUND OF THE INVENTION

Liquid ink printers of the type frequently referred to as continuous stream or as drop-on-demand, such as piezoelectric, acoustic, phase change wax-based or thermal, have at least one printhead from which droplets of ink are directed towards a recording medium. Within the printhead, the ink is contained in a plurality of channels. Power pulses cause the droplets of ink to be expelled as required from orifices or nozzles at the end of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges from the channel orifice followed by collapse of the bubble. The ink within the channel then retracts and separates from the bulging ink thereby forming a droplet moving in a direction away from the channel orifice and towards the recording medium whereupon hitting the recording medium a drop or spot of ink is deposited. The channel is then refilled by capillary action, which, in turn, draws ink from a supply container of liquid ink.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage which is reciprocated to print one swath of information (having a width equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Many liquid inks and particularly those used in thermal ink jet printing, include a colorant or dye and a liquid which is typically an aqueous liquid vehicle, such as water, and/or a low vapor pressure solvent. The ink is deposited on the substrate to form an image in the form of text and/or graphics. Once deposited, the liquid component is removed from the ink and the paper to fix the colorant to the substrate by either natural air drying or by active drying. In natural air drying, the liquid component of the ink deposited on the substrate is allowed to evaporate and to penetrate into the substrate naturally without mechanical assistance. In active drying, the recording medium is exposed to heat energy of various types which can include infrared heating, conductive heating and heating by microwave energy.

Active drying of the image can occur either during the imaging process or after the image has been made on the recording medium. In addition, the recording medium can be preheated before an image has been made to precondition the recording medium in preparation for the deposition of ink. Preconditioning of the recording medium typically prepares the recording medium for receiving ink by driving out excess moisture which can be present in a recording medium such as paper. Not only does this preconditioning step reduce the amount of time necessary to dry the ink once deposited on the recording medium, but this step also improves image quality by reducing paper cockle and curl which can result from too much moisture remaining in the recording medium.

Various drying mechanisms for drying images deposited on recording mediums are illustrated and described in the following disclosures which may be relevant to certain aspects of the present invention.

In U.S. Pat. No. 4,970,528 to Beaufort et al., a method for uniformly drying ink on paper from an ink jet printer is described. The printer includes a uniform heat flux drier system including a 180° contoured paper transport path for transferring paper from an input supply tray to an output tray. During transport, the paper receives a uniform heat flux from an infrared bulb located at the axis of symmetry of the paper transport path. Reflectors are positioned on each side of the infrared bulb to maximize heat transmission from the bulb to the paper during the ink drying process.

U.S. Pat. No. 5,005,025 to Miyakawa et al. describes a printer having means for heating a recording sheet and fixing ink thereon. A fixing means is located adjacently to a recording head or extending from the recording area to ejecting rollers.

U.S. Pat. No. 5,214,442 to Roller describes an adaptive drier for a printing system which obtains values representing mass of ink and/or area coverage of ink on a page.

U.S. Pat. No. 5,274,400 to Johnson et al., describes an ink path geometry for high temperature operation of ink jet printheads. A heating means is positioned close to a print zone for drying of the print medium. The heating means includes a print heater and a reflector which serve to concentrate the heat on the bottom of the print medium through a screen.

U.S. Pat. No. 5,287,123 to Medin et al., describes a color ink jet printer having a heating blower system for evaporating ink carriers from the print medium after ink-jet printing. A print heater halogen quartz bulb heats the underside of the medium via radiant and convective heat transfer through an opening pattern formed in a print zone heater screen.

U.S. Pat. No. 5,500,667 to Schwiebert et al. describes a method and apparatus for heating the print medium in an ink jet printer. The printer includes a print area heater. The printer has a preheater along the medium path, with an unheated area between the print area and the preheater.

SUMMARY OF THE INVENTION

In accordance with one aspect of the present invention, there is provided a printing machine for printing an image including colorants, including a liquid carrier, on a recording medium moving along a path through a pre-print zone and a print zone. The printing machine includes a printhead, disposed adjacent the print zone, to deposit the colorants, including the liquid carrier, on the recording medium during movement through the print zone and a pre-print zone drier, disposed adjacent the pre-print zone, to generate a heat energy, towards the recording medium, sufficiently elevated for retention in the recording medium during movement thereof through the print zone.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
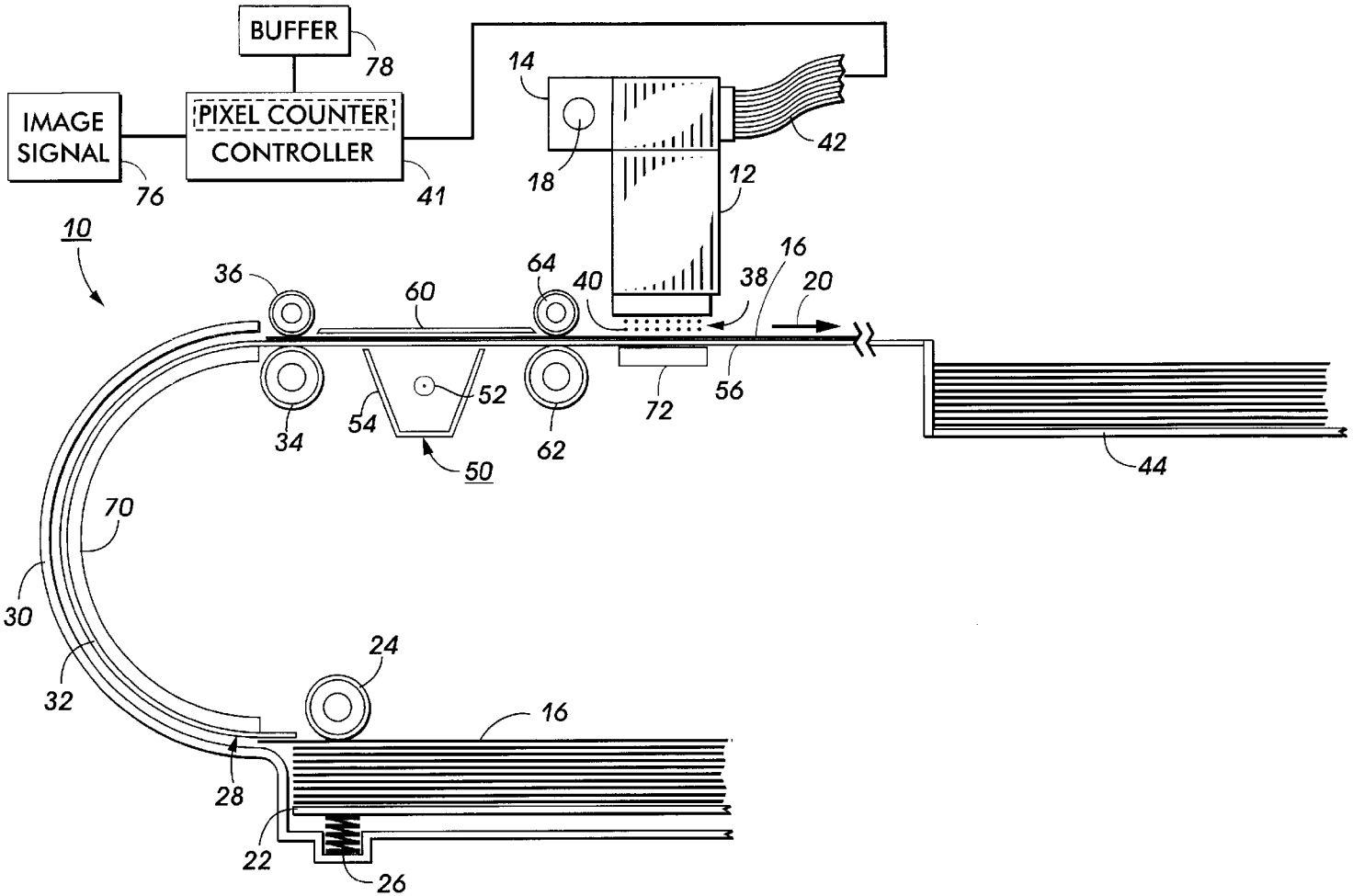
FIG. 1 is a schematic side elevational view of a liquid ink printer having a heat and hold drier with an integral reflector located in a pre-print zone.

Although the present invention discussed herein may be used for drying any image which is created by a liquid ink printer, the description of the present invention will be described in the environment of an ink jet printer such as that shown in FIG. 1. FIG. 1 illustrates a schematic representation of a thermal ink jet printer 10 in a side elevation view. A translating ink jet printhead 12 depositing colorants, including a liquid carrier, by a carriage 14 which moves back and forth across a recording medium 16, for instance, sheets of paper or transparencies, on a guide rail 18. Multiple printheads printing different, black and/or colored inks for instance, are also within the scope of this invention. The recording medium 16 is moved along a recording medium path through the printer in the direction noted by the arrow 20. Single sheets of the recording medium 16 are fed from a tray 22 by a document feed roll 24. The document tray 22 is spring biased by a biasing mechanism 26 which forces the top sheet of the stack of recording sheets held by the tray 22 into contact with the feed roll 24. The topmost recording medium 16, in contact with the drive roll 24, is transported by the drive roll 24 into a chute 28 which is defined by an outer guide member 30 spaced from an inner guide member 32, each of which are curved to thereby reverse the direction of the recording sheets 16 for printing by the printhead 12. Once the recording medium exits the chute 28, the recording medium 16 is driven into the nip of a drive roll 34 cooperating with a pinch roll 36 to advance the recording sheet 16 into a print zone 38.

The print zone 38 is the area directly beneath the printhead 12 where droplets of ink 40 are deposited by an array or more than one array of ink nozzles printing a swath of information and arranged on a front face of the printhead. The front face of the printhead is substantially parallel to the recording medium. The carriage 14, traveling orthogonally to the recording medium 16, deposits the ink droplets 40 upon the recording medium 16 in an imagewise fashion. The printhead 12 receives ink from either an attached ink tank or from an ink supply tube coupled to separate ink supplies (not shown). The image deposited upon the recording medium 16 can include text and/or graphic images, the creation of which is controlled by a controller 41, known to those skilled in the art, in response to electrical signals traveling through a ribbon cable 42 coupled to the printhead 12. Before the recording medium 16 has completely left control of the drive roll 34 and the pinch roll 36, an exit drive roll/pinch roll combination (not shown) or other known means captures the leading edge of the recording medium 16 for transport to an output tray 44 which holds printed recording medium.

To fix the liquid ink to the recording medium 16, the moisture must be driven from the ink and the recording medium. While it is possible to dry the ink by natural air drying, natural air drying can create certain problems such as cockle or curl and can also reduce the printing throughput of the printer. Consequently, active drying by the application of heat energy to the printed recording medium is preferred.

One known thermal ink jet drier, such as is utilized in the Hewlett Packard 1200C desk jet printer, uses a combination of contact backside preheating of the recording media with a "dry while printing" radiant infrared energy source concentrated at the backside of the recording medium in a print zone. While this combination of contact backside preheating and drying in the print zone adequately dries the liquid carrier from ink as the image is printed, such a method includes several disadvantages such as heating of the print head which can thermally stress the printhead and printhead electronics which can, among other things, affect the size of the ink droplets ejected.

The present invention provides an alternative to such a drying method and includes several advantages over that of the combination preheat/print zone heating. The present invention will generally be referred to as a "heat and hold drier". By using a heat and hold drier, the recording medium, such as paper or other known media, is heated outside the print zone to an elevated temperature. The heat energy stored in the media prior to the print zone, a pre-print zone, is used to evaporate the liquid ink carrier as the image is printed in the print zone, which either has no drier or a drier generating a lesser amount of heat energy than the heat and hold drier.

Figure 2:
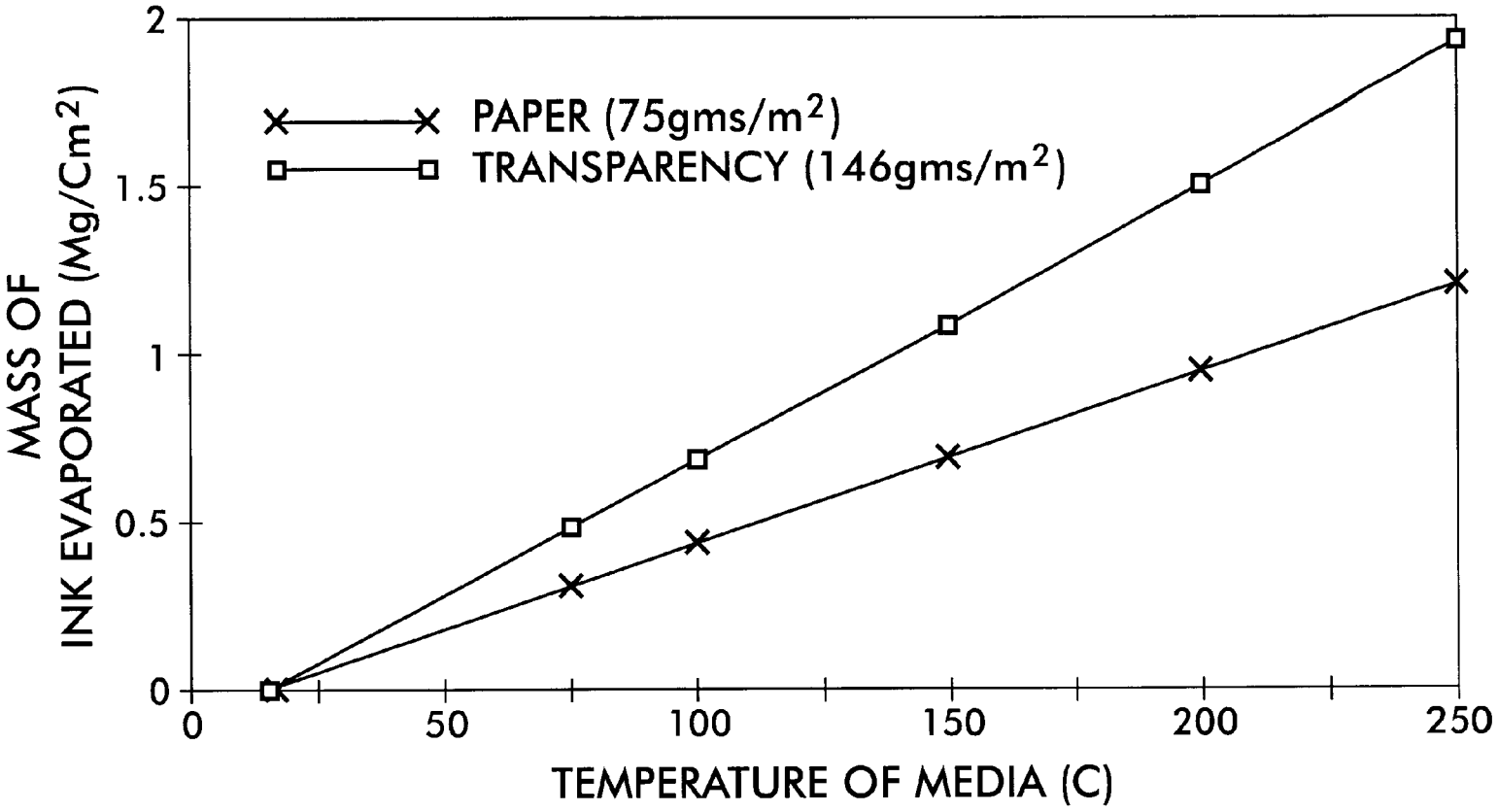
FIG. 2 is a graph illustrating the relationship between temperature of the media and the amount of ink evaporated.

It has been determined that there is a relationship between the media temperature and the amount of water based liquid that can be evaporated from the media. For instance, as shown in FIG. 2, it can be seen that for a reasonable maximum paper temperature of approximately 150° to 200° centigrade, at a high ink coverage of approximately 1.8 milligram/centimeters$^2$, about 50–60% of the moisture can be evaporated from bond paper. In this case, it has been found that there is sufficient evaporation of the liquid carrier such that the liquid carrier is no longer present on the surface of the paper with some remainder of the liquid ink being absorbed into the paper. Taking this one step further, since it is believed that intercolor bleed is primarily a diffusion phenomenon that occurs when liquid carriers are present on the surface of the paper, the present invention further reduces the amount of this printing defect.

Figure 3:
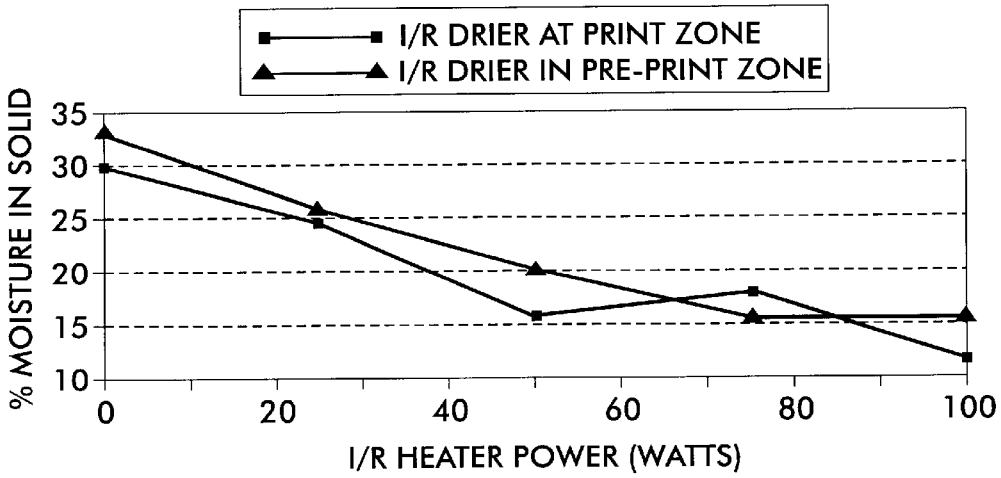
FIG. 3. is a graph illustrating a comparison the heat and hold drier and a drier located in a print zone.

To further test the efficacy of the present invention, a comparison of the heat and hold drier configuration was compared to an identical infrared drier placed in the print zone. A graph illustrating this comparison is shown in FIG. 3. The graph shows a thermal ink jet drying comparison plotting percentage of moisture in a solid versus the infrared heater power in watts using a 20 pound 4024 DP paper for the analysis. The drying efficiency of identical infrared lamps and reflectors, one being placed just prior to the print zone and the other being placed in the print zone, were measured with a water based ink being delivered at approximately 1.8 milligrams/centimeters$^2$ at a print speed of approximately two pages per minute. As can be seen, both of the configurations show that approximately 50% of the ink mass is evaporated between 50 and 75 watts.

Much less heating of the print cartridge occurs in the present invention especially between the printing of images and also during warm up. In fact, warm up can be more aggressive with the present approach since the heat and hold drier is distanced from the print head. Likewise there is a lessor chance that there will be paper instability due to differential moisture expansion which can occur if the paper arrives at the print zone having too much moisture. In addition, if the heat and hold drier utilizes an infrared lamp, there is no ink contamination on the lamp as has been found in the lamp of the HP1200C, since the HP1200C lamp is located beneath the print head where ink droplets pass though a screen.

To achieve the advantages of the heat and hold drier, the heat and hold drier includes a heater lamp 52 located within a reflector housing 54 as illustrated in FIG. 1. The heater lamp 52 can be a quartz tube surrounding a resistive filament wire such as iron-aluminum chromium alloy. The quartz tube surrounding the filament wire essentially serves as a protective device for preventing the filament wire from contacting other components and is a high temperature material to prevent breakage. The resistive filament disposed therein includes a length approximately equal to the width of the recording sheet 16 such that the heat energy generated by the filament wire is applied sufficiently across the width of the recording sheet as it passes the heat and hold drier 50. One diameter possible for the quartz tube is approximately 4 millimeters although other diameters are also possible. Tungsten halogen lamps are also within the scope of the invention.

The heat energy generated by the heater lamp 52 is directed towards the back side of the recording medium 16 by reflector housing 54. The reflector housing can be of any known reflective materials such as aluminum.

Figure 4:
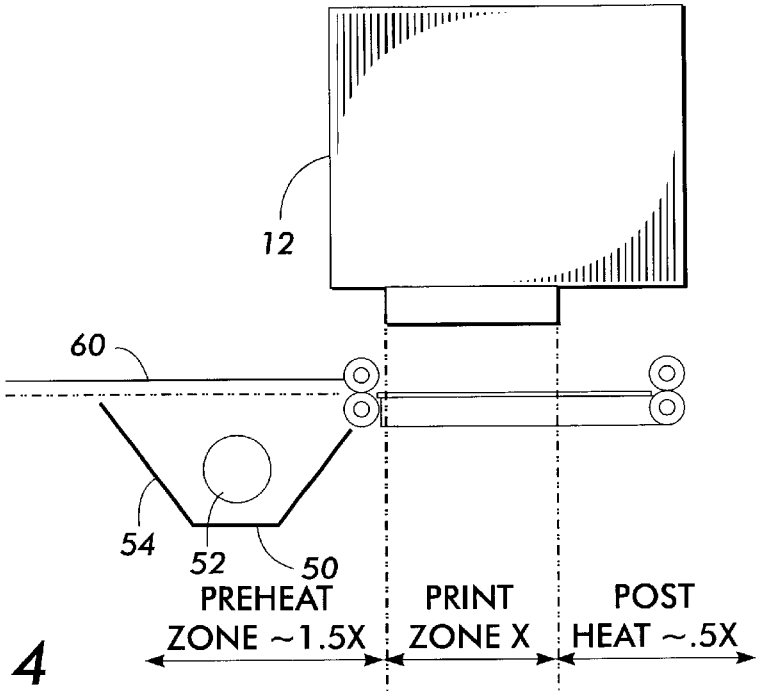
FIG. 4 is a schematic representation of the heat and hold drier and the printhead including the location of various zones.

The drier 50 is located beneath a substantially planar support platen 56 defining a substantially planar surface with a plurality of apertures 58, as illustrated in FIG. 4. The heat energy generated by the lamp 52 is reflected by the reflector 54 through the apertures 58 towards the backside of the recording medium 16. To further increase the drying potential of the drier 50 as well as to maintain the necessary level of heat energy stored within the recording medium as it passes through the area before the print zone 40, a second reflector 60 is located above the platen 56 such that the recording media 16 passes between the platen 56 and the reflector 60. The combination of the reflector 54 and the reflector 60 defines a chamber through which the paper passes such that the heat energy generated by the lamp 52 can be more easily maintained at the proper level. In addition, because the combination of the reflector 54 and the reflector 60 create an area of increased heat holding capacity, it is possible that the quartz lamp 52 may be operated at a lower energy level.

An additional drive roll 62 and a pinch roll 64 can be used to advance the recording medium 16 through the print zone 38.

Figure 5:
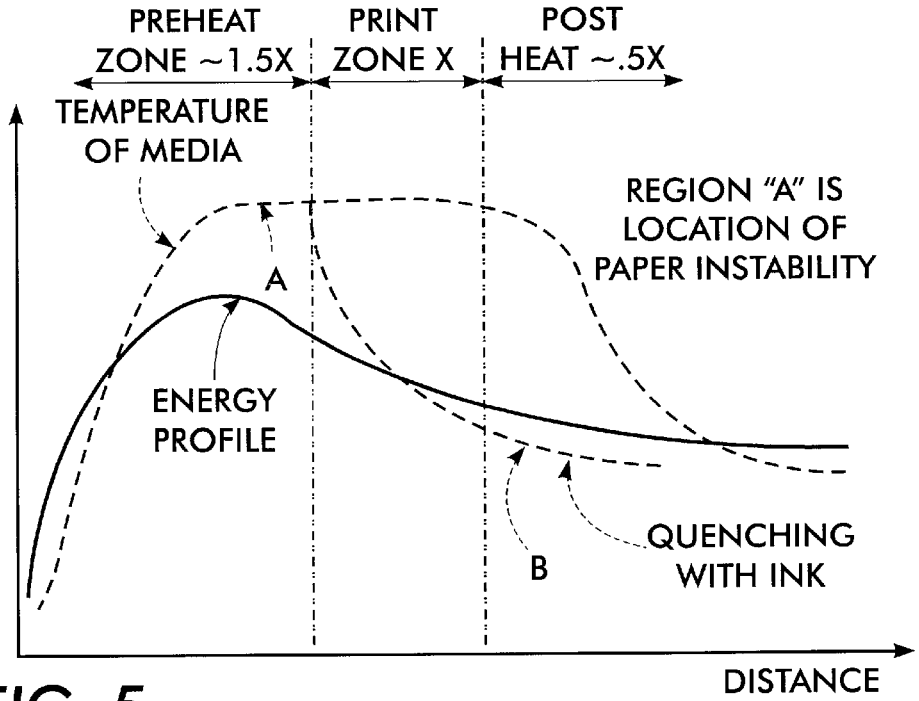
FIG. 5 is a graph of the energy profile and the temperature of the media with respect to the zones of FIG. 4.

FIG. 4 illustrates a schematic representation of the heat and hold drier 50, and the print head 12 as well as one embodiment of the present invention including a preheat zone, a print zone and a post heat zone being sized with respect to one another. In addition, a graph of FIG. 5, illustrates the temperature of the media with respect to the zones of FIG. 4 and illustrates, not only the energy profile of the system but also the temperature of the media with respect to the various zones. As can be seen, with a pre-heat zone of approximately 1.5 times the print zone and a post heat zone of approximately 0.5 times the print zone, the temperature of the media illustrated by the dotted line A, indicates that the temperature of the media rises to a particular level and is maintained at that level within the print zone and then drops off as it enters and then exits the post heat zone. A second dotted line B, however, indicates that when the print media is deposited with ink the temperature of the media dramatically falls off when quenched with ink. The energy profile of the preheat zone is the greatest and the energy thereafter drops off when the print zone or the post heat zone are taken into account.

Returning now to FIG. 1, the present invention includes a preheater 70 which is attached to the inner guide number 32. Such a preheater can be a contact style of preheater which warms up the recording media such that the moisture is driven from the media. The preheater 70 does not need to generate a large amount of heat energy and generating a temperature of between 100 degrees and 200 degrees centigrade is acceptable. In this situation the drier 50 would not need to be of a wattage sufficient to completely dry the excess moisture from the recording medium and consequently the heat energy supply thereby could be less thereby improving the heat management of the overall system and reducing the amount of heat which is absorbed by the print head 12. In addition, a segmented flexible preheater, such as that described in U.S. patent application Ser. No. 08/523,322, herein incorporated by reference, having the title "Segmented Flexible Heater For Drying a Printed Image" and a filing date of Sep. 5, 1995, can also be used.

Figure 6:
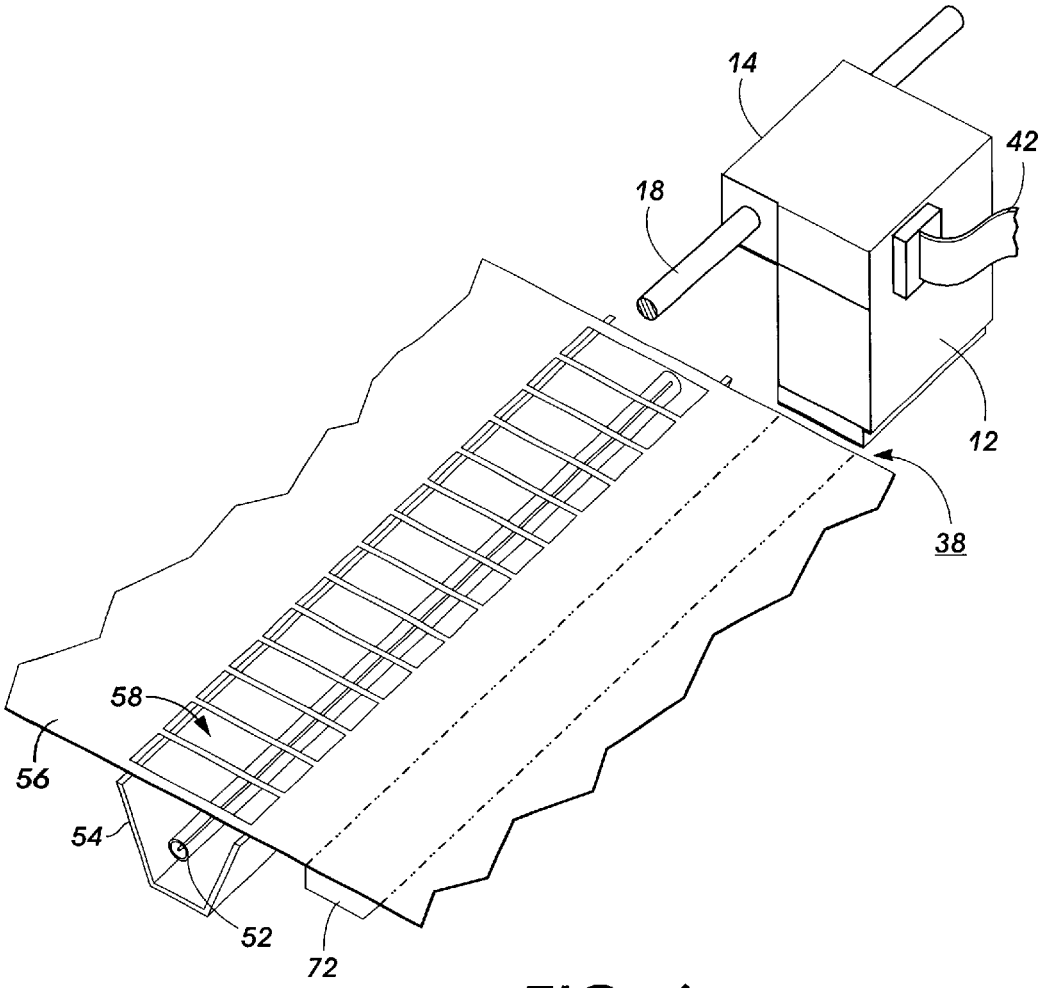
FIG. 6 is a schematic perspective view of a pre-print zone drier and a secondary contact heater in the print zone.

While the pre-print zone heater 50 of FIG. 1 provides much less heating of the print head, as well as allowing a more aggressive warm up, the graph of FIG. 5 illustrates that paper does not store heat effectively. Consequently, it may be desirable to add a small contact heater 72, in the print zone, as illustrated in FIG. 6. The contact heater 72 would contact the platen 56 and provide a heated area beneath the print head 12. The contact heater 72, however, would be a low power device having an energy output less than the heater 50 to avoid negative heating impact upon the print head 12. The main function of the contact heater 72 is to prevent heat loss as the media is advanced into the print zone. A secondary function of the contact heater 72 would be to aid in the drying of ink when printing transparencies. Conduction heating, as opposed to radiant heating in the print zone, does not work well with absorbent paper because of the problem with non-uniform contact that occurs when even a small amount of cockle develops in the paper. Transparency materials, however, do not suffer from non-uniform contact behavior and therefore conduction heating is advantageous. The additional heat energy that transparencies require since they do not absorb much if any of the carrier liquid is supplied by the contact heater. It would, of course, be also possible to sense for the presence of transparencies and turn on or off the contact heater 72 appropriately.

In both of the embodiments of FIG. 1 and FIG. 6, an additional factor enters into the drying of images deposited on the media since the amount of colorant varies over the recording media and consequently the drying load is asynchronous. This means that portions of the images on particular sections of the media may require additional drying time. To improve the drying of such portions of the image, the controller 41 operating in response to an image signal 76 examines swaths of the image which are stored in a buffer 78 to determine areas of high load drying potential of the media. The controller 41 includes a pixel counter or other means of determining ink mass. The controller 41 would then control the speed of the recording medium 16 as it passes by the pre-print zone drier 50 such that when high areas of print load occur the paper advance mechanism is reduced in speed to slow the media advance accordingly.

Figure 7:
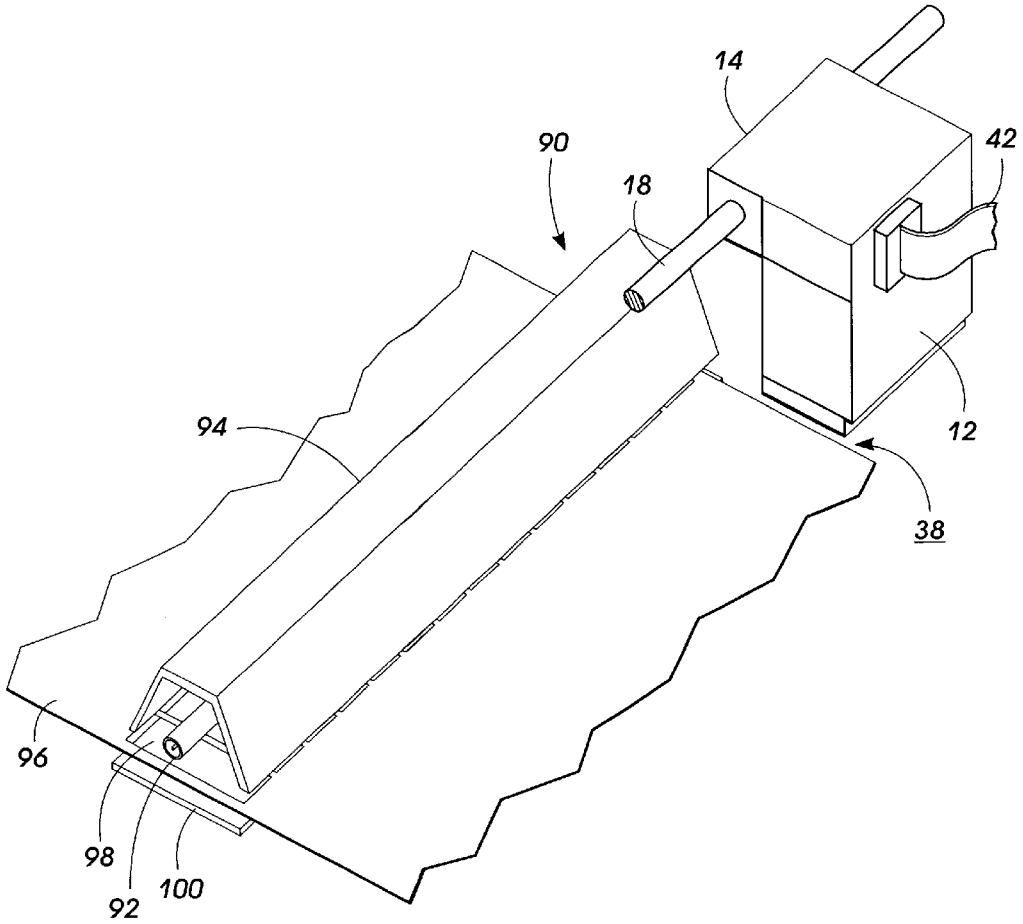
FIG. 7 is a schematic perspective view of another embodiment of the present invention.

FIG. 7 is a schematic perspective view of another embodiment of the present invention. As can be seen, a heat and hold drier 90 is located directly adjacent the ink receiving surface of the media. A lamp 92 and a reflector 94 are disposed adjacent to a media support surface or platen 96 which includes a plurality of apertures 98 defined in the platen. The heat energy is directed towards the surface of the recording media which is to receive the ink upon entering the print zone. As in the previous embodiments, a reflector 100 can be included to maintain the heat energy in the pre-print zone. The apertures 98 and reflector 100 are not essential, however, as the platen 96 may be sufficiently reflective to maintain the heat energy in the pre-print zone.

While this invention has been described in conjunction with a specific embodiment thereof, in an ink jet environment, it is evident that many alternatives, modifications, and variations will be apparent to those skilled in the art. For instance, the present invention is not limited to the embodiments shown, but is applicable to any liquid ink printer. For instance, in one practical embodiment of the present invention, the heat and hold drier could be a ceramic contact drier. Accordingly, it is intended to embrace all such alternatives, modifications and variations that fall within the spirit and broad scope of the appended claims.

What is claimed is:

1. A printing machine for printing an image including colorants, including a liquid carrier, on a recording medium, including a surface, receiving the colorants, moving along a path through a pre-print zone and through a print zone, comprising:

a printhead, disposed at the print zone, to deposit the colorants, including the liquid carrier, on the recording medium during movement through the print zone; and a pre-print zone drier, disposed within the pre-print zone upstream of the print zone, to heat the recording medium to an elevated temperature between 150° C. and 200° C. so as to generate sufficiently elevated heat energy for retention in the recording medium during movement thereof downstream through the print zone.

2. The printing machine of claim 1, wherein said preprint zone drier includes a heat energy source, and a first reflector, disposed opposite said heat energy source such that the recording medium passes between said first reflector and said heat energy source.

3. The printing machine of claim 2, including a second reflector; disposed adjacent to said heat energy source and defining with said first reflector a chamber to partially enclose a portion of the recording medium.

4. The printing machine of claim 1, including a print zone drier, disposed at the print zone, to generate a print zone heat energy sufficient to substantially maintain energy retained in the recording medium from the pre-print zone drier.

5. The printing machine of claim 1, wherein said pre-print zone drier is disposed within the pre-print zone, to direct the heat energy towards a reflective surface, other than the recording medium surface.

* * * * *